US006010187A

United States Patent [19]

Dallas et al.

[11] Patent Number: 6,010,187

[45] Date of Patent: Jan. 4, 2000

[54] CHAIR FOR A MECHANIC

[75] Inventors: W. Gordon Dallas, Ashland; Kirt E. Whiteside, Marion; Terry L. Whiteside; Robert E. Whiteside, both of Delaware, all of Ohio

[73] Assignee: Whiteside Mfg. Co., Delaware, Ohio

[21] Appl. No.: 09/109,391

[22] Filed: Jul. 2, 1998

[51] Int. Cl.[7] ..... A47C 7/62

[52] U.S. Cl. ..... 297/188.08; 297/188.12; 297/188.2; 297/173; 108/94; 280/32.6; 280/32.5; 280/47.34; 280/47.35; 280/79.11; 280/79.2; 280/79.3; 211/70.6; 211/131.1; 312/249.8; 312/235.2; 312/249.13

[58] Field of Search ..... 297/188.08, 188.12, 297/188.2, 173; 108/94; 280/32.6, 32.5, 47.34, 47.35, 79.11, 79.2, 79.3; 211/70.6, 158, 144, 131.1, 133.6; 312/235.2, 235.4, 235.5, 249.8, 249.13

[56] References Cited

U.S. PATENT DOCUMENTS

| | | | |
|---|---|---|---|
| Re. 35,732 | 2/1998 | Shockley | 280/32.6 |
| 1,660,521 | 2/1928 | Nordgren | 211/70.6 |
| 2,524,877 | 10/1950 | Bergman | 211/131.1 |
| 2,818,266 | 12/1957 | Cabler | 280/32.5 |
| 2,833,550 | 5/1958 | Frick | 280/47.34 |
| 3,498,471 | 3/1970 | Dirkx | 211/131.1 |
| 3,976,155 | 8/1976 | Esch | 280/32.5 |
| 4,119,044 | 10/1978 | Hines | 280/47.34 X |
| 4,373,761 | 2/1983 | Hansberry, Jr. | 280/47.35 X |
| 4,397,374 | 8/1983 | Rumage et al. | 280/32.5 |
| 4,531,645 | 7/1985 | Tisbo et al. | 211/70.6 X |
| 4,542,909 | 9/1985 | Littwin et al. | 280/47.35 X |
| 4,632,410 | 12/1986 | Bainbridge et al. | 280/32.5 |
| 4,832,355 | 5/1989 | Hung | 280/32.5 |
| 5,072,955 | 12/1991 | Holland et al. | 280/32.5 |
| 5,100,198 | 3/1992 | Baltzell | 312/235.2 |
| 5,460,392 | 10/1995 | Hansen | 280/32.6 |
| 5,577,744 | 11/1996 | Parks | 280/32.6 |
| 5,695,205 | 12/1997 | Liu | 280/79.2 |
| 5,707,067 | 1/1998 | Smith | 280/32.6 |
| 5,899,469 | 5/1999 | Pinto et al. | 280/79.11 |
| 5,899,526 | 5/1999 | LaPoint et al. | 297/173 |

FOREIGN PATENT DOCUMENTS

| | | | |
|---|---|---|---|
| 2569948 | 3/1986 | France | 297/188.12 |
| 4306403 | 12/1993 | Germany | 280/32.6 |
| 4223626 | 1/1994 | Germany | 312/249.8 |
| 1237162 | 6/1986 | U.S.S.R. | 312/249.13 |

OTHER PUBLICATIONS

"Vehicle Ramps, Wheel Chocks, Creeper & Creeper Set" Omega Lift Equipment advertisement, 1 page, (undated).
R.E.L. Products, Inc. advertisement, 3 pages, (undated).
Whiteside Catalog 93, 2 pages, (1993).
Whiteside Catalog 97, 4 pages, (1997).

*Primary Examiner*—Peter M. Cuomo
*Assistant Examiner*—Rodney B. White
*Attorney, Agent, or Firm*—Renner, Kenner, Greive, Bobak, Taylor & Weber

[57] ABSTRACT

A seat (10) especially adapted for use by a mechanic includes a frame (11) which carries a seat cushion (21) and a lower tray (22). A tray frame (35) removably carries an upper tray (30) and is pivotally attached to the frame (11) by a pivot assembly (40). The pivot assembly (40) includes a hollow rod (41) attached to the tray frame (35). A coil spring (42) which carries pivot pins (43, 44) is slidably received in the rod (41). The pins (43, 44) engage the frame (11) so that the tray frame (45) and the upper tray (22) carried thereby are pivotal from a first position generally under the seat cushion (21) to a second position at least partially out from under the seat cushion (21) for ready access to items carried by the upper tray (22). The frame (35) may be maintained in the first position by a fastener (45) carried by the frame (35) and engageable with the frame (11).

17 Claims, 3 Drawing Sheets

CHAIR FOR A MECHANIC

TECHNICAL FIELD

This invention relates to a chair which is particularly suited for use by a mechanic. More specifically, this invention relates to a chair which has at least one tray for holding tools and the like which is pivotal from a position generally under the seat of the chair to a position generally out from under the seat.

BACKGROUND ART

Low profile chairs, such as used by mechanics when working under an elevated vehicle, are known in the art. Usually such chairs include a seat mounted on a frame which is rendered mobile by supporting casters. At times the frame of some of such chairs carries a tray under the seat for holding tools or other supplies needed by the mechanic.

While such trays attempt to serve a useful purpose, access to them is not easily obtained when the mechanic is, for example, working under a vehicle. Since the tray is below the seat, if the mechanic is to remain seated, as would be required, his legs and the seat prohibit ready access to the contents of the tray.

Thus, the need exists for such a seat whereby the mechanic may store and carry tools and other supplies with the seat, and yet have easy access to such tools and supplies while the seat is being used.

DISCLOSURE OF THE INVENTION

It is thus an object of the present invention to provide a seat which can carry easily accessible items.

It is another object of the present invention to provide a seat, as above, which is provided with at least one tray that is pivotable from a first position generally under the seat to a second position at least partially outside the profile of the seat for ease of access to the items being carried by the tray.

It is a further object of the present invention to provide a seat, as above, in which the tray can be maintained in the first position.

It is an additional object of the present invention to provide a seat, as above, in which the tray can be removed and carried by the user.

These and other objects of the present invention, as well as the advantages thereof over existing prior art mechanic's seats, which will become apparent from the description to follow, are accomplished by the improvements hereinafter described and claimed.

In general, a seat made in accordance with the present invention includes a frame carrying a seat cushion. A tray is pivotally carried by the frame so that the tray can be located at a first position generally under the seat cushion and can be swung to a second position at least partially out from under the seat cushion.

A preferred exemplary seat, especially adapted to be used by a mechanic or the like, incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
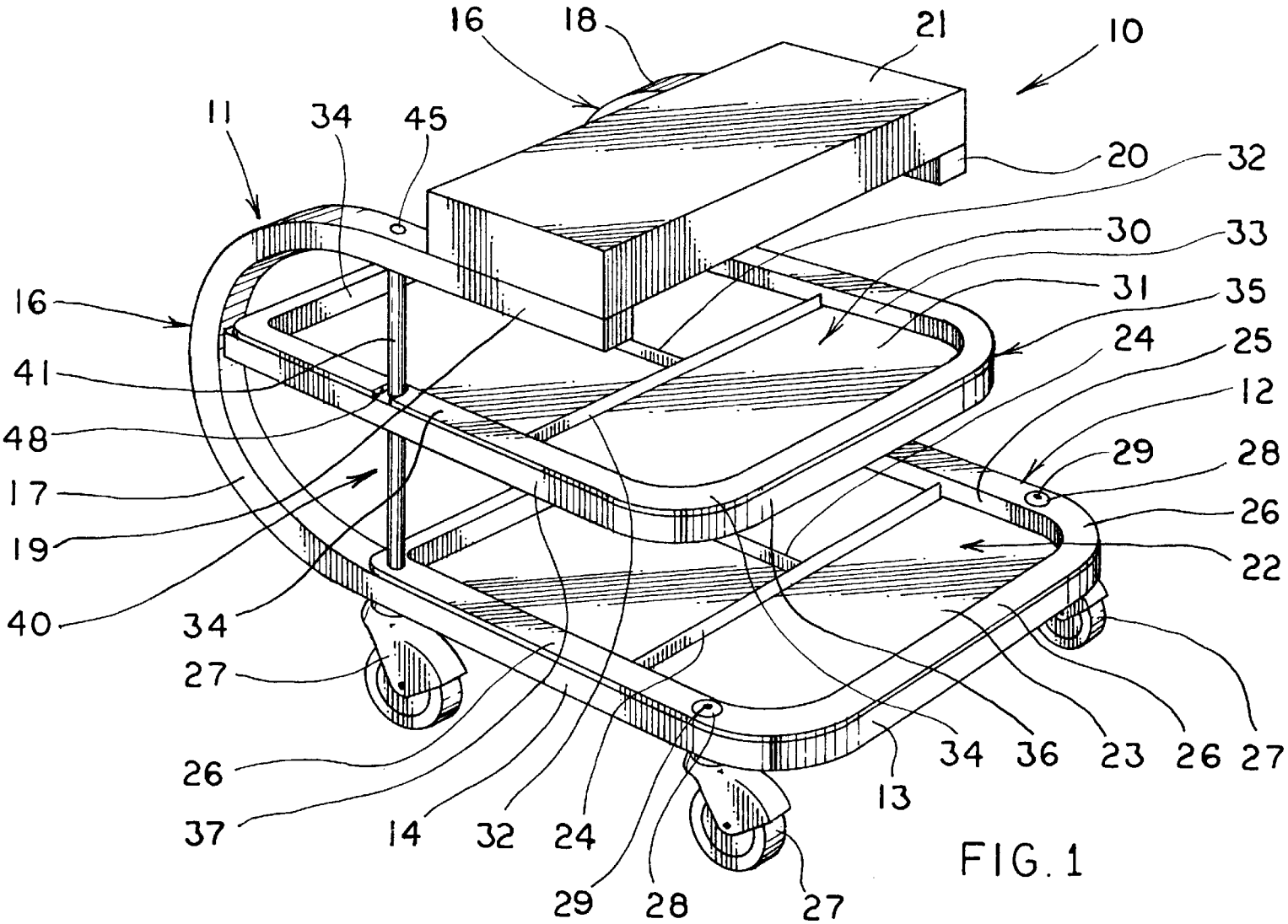
FIG. 1 is perspective view of a seat made in accordance with the present invention and showing a tray in a first position.

A seat made in accordance with the present invention is indicated generally by the numeral 10 and includes a metallic frame generally indicated by the numeral 11. Frame 11 includes a base portion, generally indicated by the numeral 12, which is generally U-shaped when viewed in plan. Thus, base portion 12 includes a front rail 13 which interconnects side rails 14 and 15 which extend rearwardly from front rail 13 to form the generally U-shape.

Frame 11 also includes elevating portions, generally indicated by the numeral 16, which are generally U-shaped when viewed in side elevation. Thus, elevating portions 16 each include curved back portions 17 and 18 which are a continuation of side rails 14 and 15, respectively, and which extend upwardly to form spaced seat rails 19 and 20, respectively. As shown, seat rails 19 and 20 double back on and are preferably directly vertically over at least a portion of side rails 14 and 15. A seat cushion 21 is mounted on the top of, and extends between, seat rails 19 and 20.

Base portion 12 of frame 11 may be provided with a tray, generally indicated by the numeral 22, which could be made of a lightweight metallic material but which is preferably made of a sturdy plastic material. Tray 22 includes a flat bottom surface 23 which is divided into item-containing compartments by ribs 24. A side wall 25 extends upwardly from the periphery of bottom surface 23, and a generally horizontal peripheral flange 26 extends outwardly from the top of side wall 25. Flange 26 is thus adapted to rest on front rail 13 and side rails 14, 15 of base portion 12 of frame 11.

Tray 22 is preferably permanently attached to base portion 12 of frame 11 in a manner now to be described. Base portion 12 carries a plurality of caster assemblies 27 which have stems extending upwardly through frame base portion 12. Caster assemblies 27 are preferable located near the junction of front rail 13 and side rails 14, 15 and at the transition point between side rails 14, 15 and curved back portions 17, 18, respectively, of frame elevating portions 16. As such, caster assemblies 27 are generally located beneath the four corners of tray 22, and their stems may also pass through peripheral flange 26 of tray 22. Caster assemblies 27 may then be attached, with tray 22, to frame base portion 12 by suitable fasteners 28. Fasteners 28 may be of any type but are preferably in the form of a nut having a socket 29 formed therein. Sockets 29 can, for example, be hexagonal in shape so that a suitable tool can be inserted therein to assemble or change caster assemblies 27.

Seat 10 is also provided with an upper tray generally indicated by the numeral 30 and vertically spaced from tray 22. Upper tray 30 may be generally identical to lower tray 22, and as such, it may be made of any suitable lightweight metallic or plastic material and includes a flat bottom surface 31 which is divided into item-containing compartments by ribs 32. A side wall 33 extends upwardly from the periphery of bottom surface 31, and a generally horizontal peripheral flange 34 extends outwardly from the top of side wall 33.

Tray 30 is preferably carried by a metallic, generally rectangular tray frame generally indicated by the numeral 35. Frame 35 includes a front rail 36 interconnecting one end of side rails 37, 38 which are interconnected at their other ends by a back rail (not shown). Rails 36, 37, 38 and the back rail support tray 30, the peripheral flange 34 thereof resting on the rails of frame 35. However, unlike tray 22, tray 30 is preferably not attached to the rails of frame 35 and, as such, tray 30 may be removed from seat 10 and transported by the user as desired.

Figure 2:
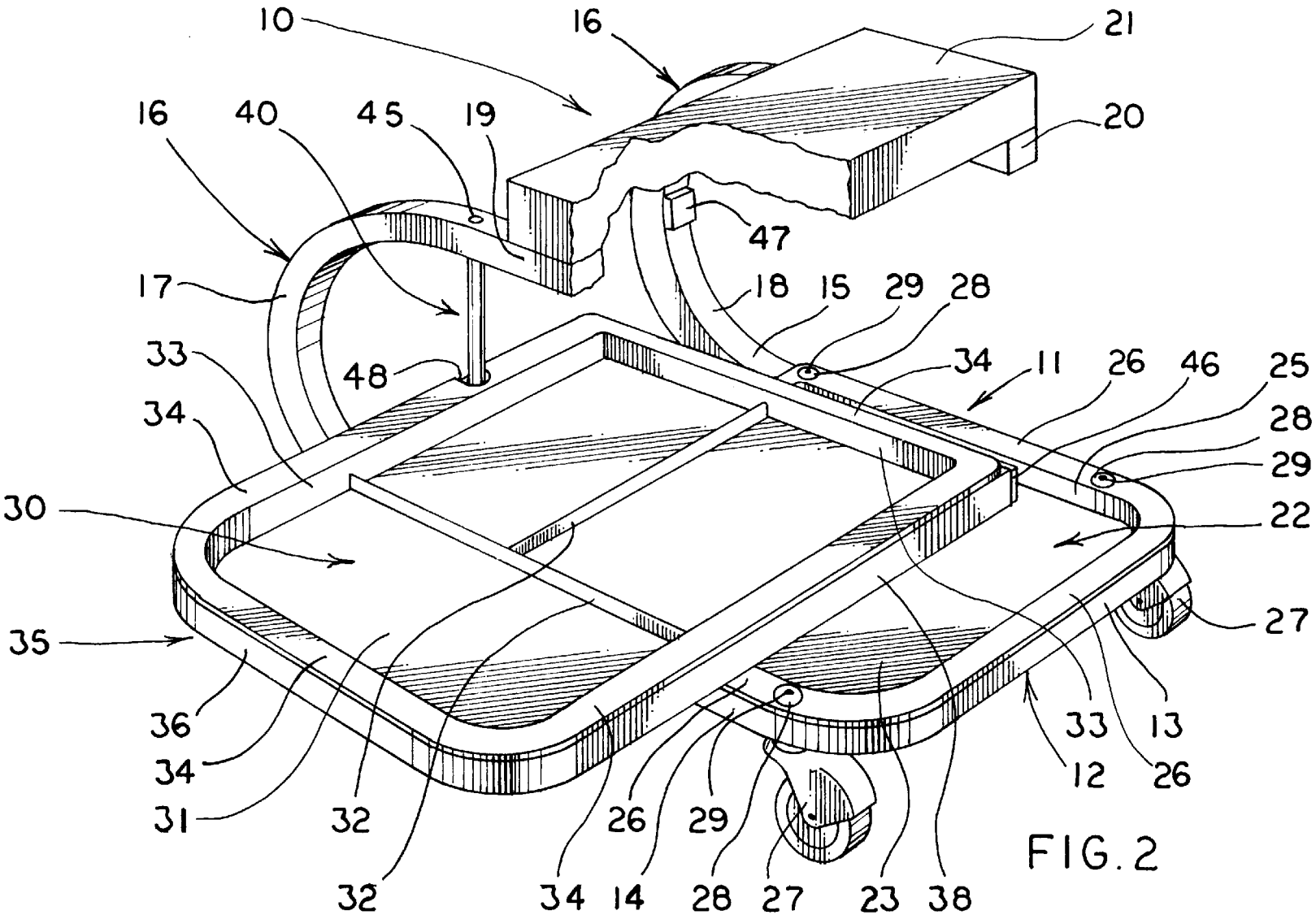
FIG. 2 is a perspective view like FIG. 1, having a portion broken away and showing a tray having been pivoted outwardly to a second position.
Figure 4:
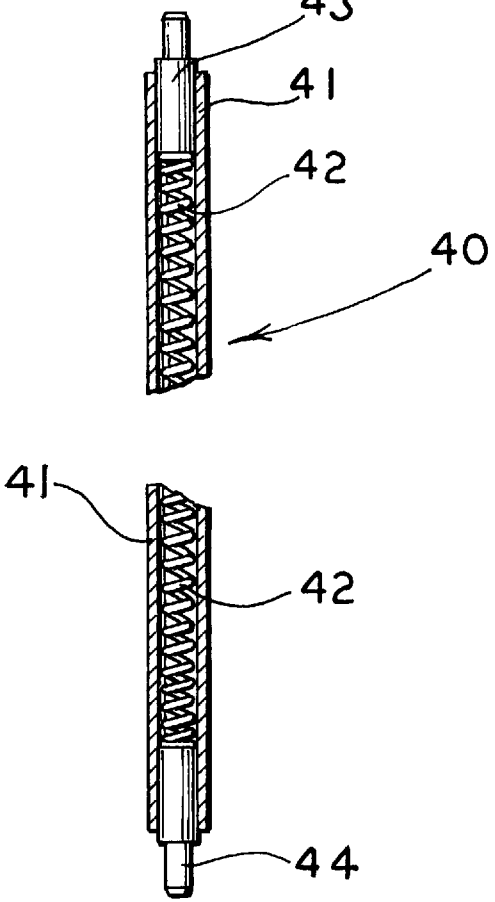
FIG. 4 is a fragmented sectional view taken substantially along line 4–4 of FIG. 3.
Figure 3:
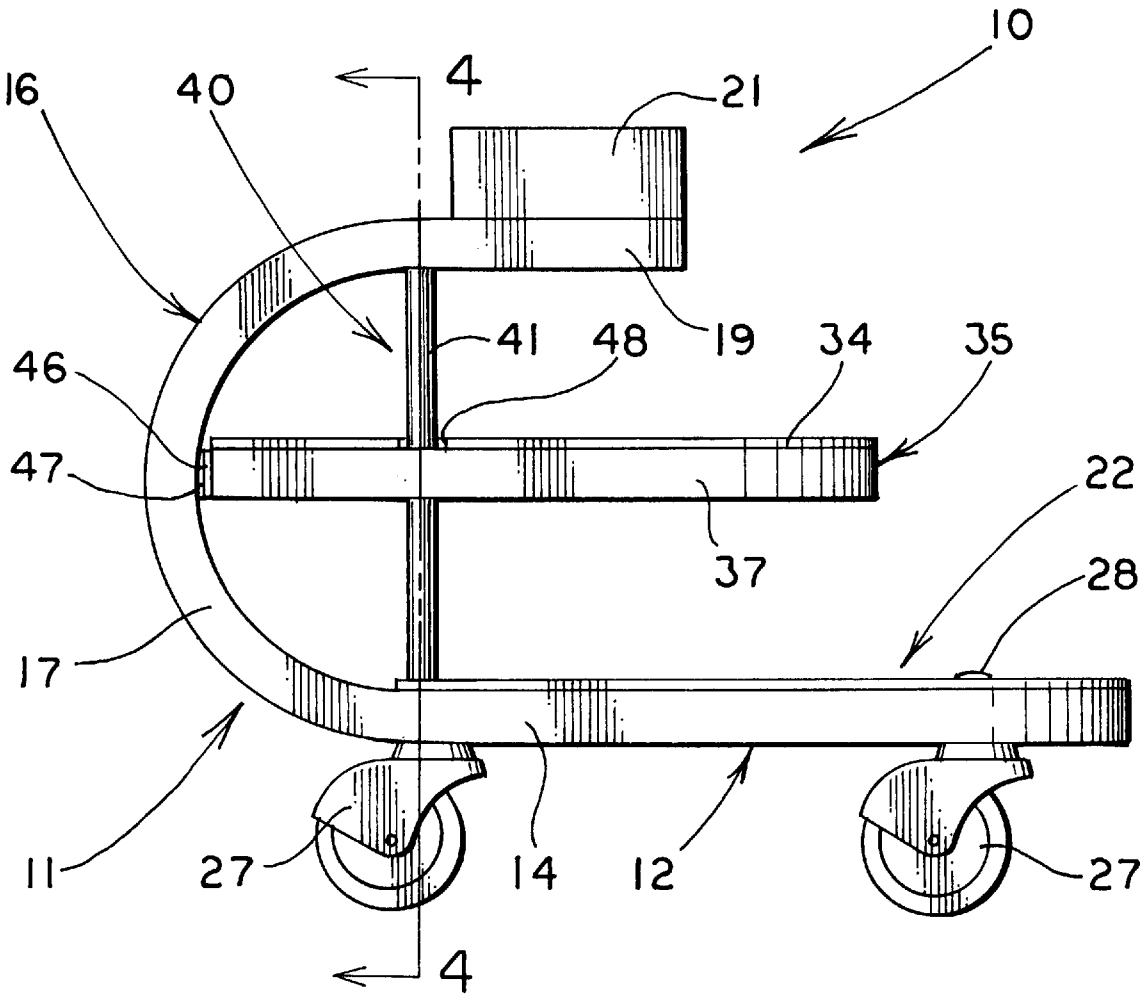
FIG. 3 is a side elevational view of the seat of FIG. 1.

Tray 30 and frame 35 are pivotally mounted relative to the rest of seat 10 so that tray 30 can be positioned at a first position, as shown in FIG. 1, at a fully pivoted second position, as shown in FIG. 2, or at any position therebetween. Such action is accomplished by a pivot assembly generally indicated by the numeral 40 and shown in detail in FIG. 4.

Pivot assembly 40 includes a hollow rod 41 which extends through and is attached to, as by welding, side rail 37 of frame 35. A biasing system in the form of a coil spring 42 and upper and lower pin members 43, 44 carried by each end of spring 42, is slidably received within rod 41. Upper pin member 43 is received in an aperture 45 formed through seat rail 19 and lower pin member 44 may conveniently be received in the socket 29 of the caster fastener 28 positioned below the location of pivot assembly 40. Alternatively, lower pin member 44 could be received in a separate aperture formed in side rail 14.

It should be apparent that pivot assembly 40 is thus easily assembled in seat 10 by merely locating either pin member 43 in aperture 45 or pin member 44 in socket 29 and then manually compressing spring 42 and snapping the other pin member 44 in socket 29 or pin member 43 in aperture 45, respectively. Tray 30 may then be easily rotated as rod 41 rotates around pin members 43, 44 and spring 42 so that the user can readily gain convenient access to the items carried by tray 30. To remove pivot assembly 40 from seat 10, as may be required if, for example, the caster assembly 27 positioned therebelow needs to be replaced, one need only insert a tool through aperture 45 to compress spring 42 and pivot assembly 40 can readily be snapped out of its installed position.

In order to maintain tray 30 in the FIG. 1 position, a fastener 46 may be positioned on the back rail of tray 30 near the corner junction with side rail 38 thereof. This fastener 46 may be in the form of a magnet or other mechanical fastener, such as a detent latch, which can engage the inside back portion 18 of frame elevating portion 16. Fastener 46 could thus be configured as any suitable fastening system, such as a Velcro® strip attachable to a like Velcro® strip 47 positioned on the inside of back portion 18. As such, tray 30 is easily maintained in the stowed position underneath seat cushion 21, but the connection afforded by fastener 46 can be readily broken and tray 30 rotated out from under seat cushion 21.

As previously described, tray 30 may be removed from frame 35. To that end, it should be noted that flange 34 of tray 30 is notched out, as at 48, and received around rod 41 of pivot assembly 40. Thus, pivot assembly 40 does not engage tray 30 so that it may be removed from frame 35.

Tray 30 has been shown as swinging out to the right of the user as he would normally be seated on cushion 21. Such may be the most convenient arrangement for a right handed person, but it should be appreciated that if desired, pivot assembly 40 could be mounted to rail 38 of frame 35 so that the pivoting direction of tray 30 would be reversed.

In view of the foregoing, it should be evident that a mechanic's seat constructed as described herein accomplishes the objects of the present invention and otherwise substantially improves the art.

What is claimed is:

1. A seat comprising a frame, a seat cushion attached to said frame, a tray frame pivotally attached to said frame, and a tray removably resting on and supported within said tray frame, such that said tray and said tray frame can be located at a first position generally under said seat cushion and can be swung to a second position at least partially out from under said seat cushion where said tray can be readily removed from said tray frame.

2. A seat according to claim 1 further comprising a pivot assembly attached to said tray frame.

3. A seat comprising a frame, a seat cushion attached to said frame, a tray frame pivotally attached to said frame, a tray supported on said tray frame, and a pivot assembly attached to said tray frame, said pivot assembly including a hollow rod attached to said tray frame, and biasing means received within said rod to pivotally attach said tray frame to said frame so that said tray can be located at a first position generally under said seat cushion and can be swung to a second position at least partially out from under said seat cushion.

4. A seat according to claim 3 wherein said tray has a peripheral flange resting on said tray frame, and a notch formed in said flange, said rod being received through said notch so that said tray may be removed from said tray frame.

5. A seat according to claim 3 wherein said biasing means includes a coil spring and pin members carried at each end of said spring, said pin members engaging said frame.

6. A seat according to claim 5 further comprising at least one aperture formed in said frame, one of said pin members being received in said aperture.

7. A seat comprising a frame, a seat cushion attached to said frame, a tray pivotally attached to said frame so that said tray can be located at a first position generally under said seat cushion and can be swung to a second position at least partially out from under said seat cushion, and a fastener to attach said tray to said frame in said first position.

8. A seat according to claim 7 wherein said fastener includes a hook and loop fastener attached to said tray and a mating hook and loop fastener attached to said frame.

9. A seat according to claim 1 further comprising a second tray attached to said frame.

10. A seat according to claim 9 further comprising caster assemblies attached to said frame.

11. A seat comprising a frame, a seat cushion attached to said frame, a tray pivotally attached to said frame so that said tray can be located at a first position generally under said seat cushion and can be swung to a second position at least partially out from under said seat cushion, a second tray, caster assemblies supporting said frame, and fasteners to attach both said second tray and said caster assemblies to said frame.

12. A seat according to claim 11 where in said fasteners have a socket therein, and further comprising a tray frame supporting said tray, and a pivot assembly attached to said tray frame, said pivot assembly engaging one of said sockets.

13. A seat according to claim 1 wherein said frame includes a base portion and an elevating portion, said seat cushion being attached to said elevating portion above said base portion.

14. A seat according to claim 13 wherein said tray is vertically positioned between said base portion and said seat cushion.

15. A seat according to claim 14 further comprising a second tray attached to said base portion and vertically below said tray.

16. A seat according to claim 14 further comprising a fastener to attach said tray to said elevating portion in said first position.

17. A seat according to claim 16 wherein said fastener includes a hook and loop fastener attached to said tray and a mating a hook and loop fastener attached to said elevating portion.

* * * * *